US007940288B2

(12) United States Patent
Campanini

(10) Patent No.: US 7,940,288 B2
(45) Date of Patent: May 10, 2011

(54) PRINT CONTROL DEVICE FOR A THERMAL PRINTER

(75) Inventor: Alberto Campanini, Fidenza (Parma) (IT)

(73) Assignee: Custom Engineering @ Spa, Fontevivo (Parma) (IT)

( * ) Notice: Subject to any disclaimer, the term of this patent is extended or adjusted under 35 U.S.C. 154(b) by 159 days.

(21) Appl. No.: 12/403,419

(22) Filed: Mar. 13, 2009

(65) Prior Publication Data

US 2009/0231409 A1 Sep. 17, 2009

(51) Int. Cl.
*B41J 2/35* (2006.01)

(52) U.S. Cl. ..... 347/211

(58) Field of Classification Search ..... 347/19, 347/171, 211

See application file for complete search history.

(56) References Cited

U.S. PATENT DOCUMENTS 4,996,487 A * 2/1991 McSparran et al. ..... 324/549
5,132,709 A * 7/1992 West ..... 347/191
5,422,662 A * 6/1995 Fukushima et al. ..... 347/211
6,217,144 B1 * 4/2001 Myung ..... 347/19

* cited by examiner

*Primary Examiner* — Huan H Tran
(74) *Attorney, Agent, or Firm* — J. Harold Nissen; Lackenbach Siegel

(57) ABSTRACT

A print control device for a thermal printer for detecting a failure in a component of the thermal printer to prevent an incorrect printing of an item to be printed which provides for a thermal resistor associated with each component of the printer to render the printer inoperative when the component becomes defective, and a MOSFET for each thermal resistor associated with a feeder, a driver and a group detector which prevents the printer from printing when the thermal resistor changes the effective resistance in the circuit with the MOSFET and the group detector and driver.

15 Claims, 1 Drawing Sheet

PRINT CONTROL DEVICE FOR A THERMAL PRINTER

CROSS REFERENCE TO RELATED APPLICATION

This Application is related to U.S. patent application Ser. No. 12/057,430, filed Mar. 28, 2008, in the name of the inventor of this Application and assigned to the Assignee of this Application, Custom Engineering Spa.

BACKGROUND OF THE INVENTION

1. Field of the Invention

This invention relates a print control device for thermal printers to provide for a print control device to stop printing should a problem arise.

More particularly, the invention is concerned with a method and an apparatus for controlling the amount of and the sufficient quantity of current supplied to electrical resistors associated with various parts or points of a thermal printer for control of the thermal printer head. The parts or points of the printer are those which may cause the thermal printer to provide a defective print and therefore an undesired product. In addition, a strict control is necessary to provide an indication when a particular part or mechanism of the print control device breaks down or becomes defective to prevent an incorrect printed product. Also, it is necessary to provide an indication when a part associated with the print control device becomes defective to provide a signal as soon as possible to the operating control mechanism of the thermal printer to provide an indication of the incorrect or defective operation of a defective product, part and to prevent the thermal printer from continuing its operation and thereby produce a defective product, and further to cease operation of the thermal printer.

2. Description of Related Art

One type of known print control device used by the prior art is a print control device which includes an optical sensor placed downstream with respect to the printing head of the thermal printer. An example of the aforesaid device is described in the earlier U.S. patent application Ser. No. 12/057,430, filed Mar. 28, 2009, and the subject matter thereof including the complete disclosure is incorporated herein by reference as if everything contained in the aforesaid patent application were repeated herein.

The aforesaid optical sensor in the earlier disclosure works very well and is quite useful. However, the only drawback is the cost involved because optical sensors are quite costly.

List of Alberto Campanini Applications and Patents

U.S. Pat. No. 6,798,436, issued Sep. 28, 2004 based on U.S. patent application Ser. No. 10/147,174, filed: May 8, 2002, entitled: THERMAL PRINTER CLOSING APPARATUS U.S. Pat. No. 7,175,356, issued: Feb. 13, 2007 based on U.S. patent application Ser. No. 10/939,043 filed: Sep. 10, 2004, entitled: HEAD SUPPORT BASE FOR THERMAL PRINTER U.S. Pat. No. 7,322,760, issued: Jan. 29, 2008 based on U.S. patent application Ser. No. 11/193,214 Filed: Jul. 29, 2005, entitled: ANTIJAMMING DEVICE FOR PRINTERS PUT IN PUBLIC PLACES Re: U.S. patent application Ser. No. 11/272,277
Publication No.: US 2006/0152574
Filed: Nov. 10, 2005
Title: LASER WRITING HEAD FOR PRINTER
Re: U.S. patent application Ser. No. 11/581,770
Publication No.: US 2007/0166093

Filed: Oct. 16, 2006
Title: AUTOMATIC OPENING DEVICE FOR A PRINTER GATE
Re: U.S. patent application Ser. No. 11/960,956
Publication No.: US 2008/0229892
Filed: Dec. 20, 2007
Title: LIMITING DEVICE FOR ROLL PRINTER
Re: U.S. patent application Ser. No. 12/057,430
Publication No.: US 2008/0247799
Filed: Mar. 28, 2008
Title: THERMAL PRINTER HEAD WITH PRINT CONTROL DEVICE
Re: U.S. patent application Ser. No. 12/321,216
Filed: Jan. 20, 2009
Title: PRINTING ROLL RELEASE OF THE HEAD IN THE THERMAL PRINTER
Assignee: Custom Engineering Spa

LIST OF REFERENCE NUMERALS

1 driver—containing circuit elements (1-I, 1-II, 1-III . . . 1-N)
2 wire
3 MOSFET
4 wire
5 thermal resistor
6 wire
7 feeder
8 ground wire
9 wire
10 comparator
11 wire
12 group detector containing circuit operative preventors (12-I, 12-II, 12-III . . . 12-N)

SUMMARY OF THE INVENTION

The present invention is capable of detecting an out of order or defective circuit or component, and the invention is capable of measuring the quantity of current being supplied to check whether a sufficient value or quantity is supplied and the necessary or required amount in order to have a current passage that is sufficient to have transformed the current in the thermal head, in response to heat to impress onto the point on the voucher to print on the voucher without using an optical sensor to check the accuracy and/or quantity.

By means of experiment, case histories and tests results with respect to breakdowns in the thermal heads has pointed out that the thermal resistances which are connected to the head feeder are generally the first or initial cause of breakdowns or failure inside of these printing devices.

The device, according to the invention, is capable of detecting a failure or a breakdown of a circuit part with a thermal resistance, as well as the pertinent pilotage, when there is insufficient current passing to provide an indication, such as a signaling or notice to the user.

The print control device according to the invention has as one of its main purposes and utility to detect failures or breakdowns in one or more thermal resistances 5 which includes a driver 1 connected by means of wires 2 to the gate of each MOSFET 3. Wires 4 are provided to connect each MOSFET 3 to each thermal resistance 5. The MOSFET 3 is also connected by wires 8 to a ground and biunique connection of each MOSFET 3 by means of wires 9 to a comparator 10. Each comparator 10 is connected by means of a wire 11 to a group detector 12. Any failure or breakdown in one or more of the thermal resistances 5 is pointed out and directed to a signaling device.

To these ends, the present invention consists in the provision of a print control device for a thermal printer comprising: a feeder 7 associated with a thermal printer head, thermal resistors 5 and a wire 6 for said thermal resistor for connection thereof to said feeder 7 of said thermal printer head; and a print control device for detecting a failure or breakdown of at least one of said thermal resistor 5; said control device consisting essentially of: a driver 1 and a MOSFET 3, each said MOSFET having a gate for each said thermal resistor 5; wires 2 for connecting said gate of each said MOSFET 3 to a respective of said driver 1, each said MOSFET 3 being connected at its own time by means of a wire 4 to each said thermal resistor 5; and each said MOSFET 3 being connected by a wire 8, to ground and biunique connection for each said MOSFET 3 for connection by means of a wire 9 to a comparator 10 for each said thermal resistor 5; each said comparator 10 being coupled by a wire 11 to a group detector 12 whereby a failure or a breakdown of at least one of said thermal resistor 5 is directed to a signaling device to provide a correct printing by preventing an error in the printing to take place due to a breakdown in one of said thermal resistors 5.

The present invention also provides the MOSFET 3 and driver 1 to be directly coupled with each other by said wires 2.

Another detailed aspect of the invention is the provision of a print control device for a thermal printer for detecting a failure in a component of the thermal printer to prevent an incorrect printing of an item to be printed which includes a detector 12 for receiving information and for rendering the thermal printer inoperative when an operative component becomes defective, a feeder 7 associated with a thermal printer head, at least one thermal resistor 5 indicative of and associated with each operative component of the thermal printer to check and a wire 6 for each thermal resistor for connection of the thermal resistor to the feeder 7 of the thermal printer head, a print control device for detecting a failure or breakdown of each thermal resistor 5, the control device consisting essentially of a single driver 1 including individual components for each thermal resistor, a MOSFET 3 associated with the driver for each thermal resistor 5, a wire 2 for connecting the gate of the MOSFET 3 to the driver 1 for each said resistor, the MOSFET 3 also being connected by a wire 4 to the thermal resistor 5 and to the detector 12, each MOSFET 3 also being connected by a wire 8 to ground and a biunique connection by means of a wire 9 to a comparator 10 for each thermal resistor such that the MOSFET is in series with the thermal resistor 5, each comparator 10 being coupled by a wire 11 to the group detector 12 such that a failure or a breakdown of any one or more of the operative components directed to the group detector 12 to prevent the thermal printer from continuing printing thereby to prevent an incorrect printing and to provide a correct printing by preventing an error in the printing from taking place due to the breakdown in one said operative components.

Yet another aspect of the invention is the provision of a print control device for a thermal printer capable of rendering the thermal printer inoperative when an operative component of the thermal printer becomes defective, which includes the feeder 7 associated with the thermal printer and provided with a printing head for control by the print control device, the group detector 12 which receives information about the operation and working of each operative component of the thermal renders the thermal printer inoperative when at least one operative component becomes defective or does not operate properly, the group detector includes a plurality of circuit operative preventors (12-I, 12-II, 12-III . . . 12-N), one for each operative components, the driver 1 includes a plurality circuit elements (1-I, 1-II, '-III . . . 1-N), one for each operative component and a MOSFET 3 for each circuit element and each operative components being connected to the driver 1 by a first wire 2, the thermal resistor 5 being associated with and being responsive to an improper operation of each operative component, each MOSFET 3 being connected to the feeder 7 through a respective one of the thermal resistors 5 by means of a second wire 4 for each resistor 5 and by a third wire from each resistor 5 to feeder 7, each MOSFET 3 also being connected to the group detector 12 through the comparator 10 by a fourth wire 9 connecting the comparator 10 to the MOSFET 3 and a fifth wire 11 for connecting the comparator 10 to a respective one of the plurality of circuit operative preventors (12-I, 12-II, 12-III . . . 12-N), whereby a failure or breakdown of at least one operative component causes its associated thermal resistor 5 to become activated such that its associated MOSFET also causes its associated comparator 10 to render the detector 12 operative to prevent the printer from operating and thereby to stop further operation of the thermal printer to prevent a printing error from taking place.

Each circuit element is connected to the gate of the respective MOSFET 3 associated with the operative component of the printer. To provide the ground for the print control device the emitter of the MOSFET 3 is coupled to ground. Where necessary, the emitter can also be connected to ground through circuit safety elements (not shown).

In addition, while the preferred embodiment is directed to the MOSFET 3 and its associated driver being directly coupled together, it is understood that the MOSFET 3 and the comparator 10 can also be connected together.

Another aspect of the invention is a method for controlling an output product of a thermal printer and for rendering the thermal printer inoperative when a operative component of the thermal printer becomes defective, which includes providing a thermal resistor for each of the operative components and coupling the thermal resistor to a feeder 7 associated with the thermal printer, providing the group detector 12 for receiving information about the operation and working of components of the thermal printer for rendering the thermal printer inoperative when one of the components becomes defective or does not operate properly, the group detector includes a plurality of circuit operative preventors (12-I, 12-II, 12-III . . . 12-N), one for each of the components and associated with a respective one of the thermal resistors, the driver 1 includes a plurality of circuit elements (1-I, 1-II, '-III . . . 1-N), one for each of the operative components and the MOSFET 3 for each of the circuit elements and coupling each of the thermal resistors to the driver 1, coupling each MOSFET 3 to the feeder 7 through a respective one of the thermal resistors 5 by means of wire 4 for each of the thermal resistors 5 and to the feeder 7, and coupling each MOSFET 3 to the group detector 12 through a comparator (10) to compare the normal output of the MOSFET to an inaccurate output from the MOSFET caused by one of the incorrectly operating operative components, and coupling the comparator 10 to the MOSFET 3 to a respective one of the plurality of circuit operative preventors of the group detector for activation thereof in response to an output from the MOSFET produced by the incorrectly operating component, whereby a failure or breakdown of any of the operative components associated with the thermal resistors 5 stops or prevents further operation of the thermal printer thereby preventing an error from taking place when the thermal printer is printing.

It should be noted that coupling the thermal resistor 5 to one of the operative components of the thermal printer together with the MOSFET 3 for each of the thermal resistors (5) provides a complete circuit between the detector 12 and the driver 1 so that there is complete control of the printing operation with minimal costs because of the circuitry involved.

BRIEF DESCRIPTION OF THE DRAWINGS

In order that the invention will be more clearly understood reference is made to the single FIGURE, designated FIG. 1 which is a schematic layout and representation of the circuit and interrelationship of the various elements forming part of the print control device in accordance with the teachings of the invention.

DETAILED DESCRIPTION OF THE PREFERRED EMBODIMENT OF THE INVENTION

Figure 1:
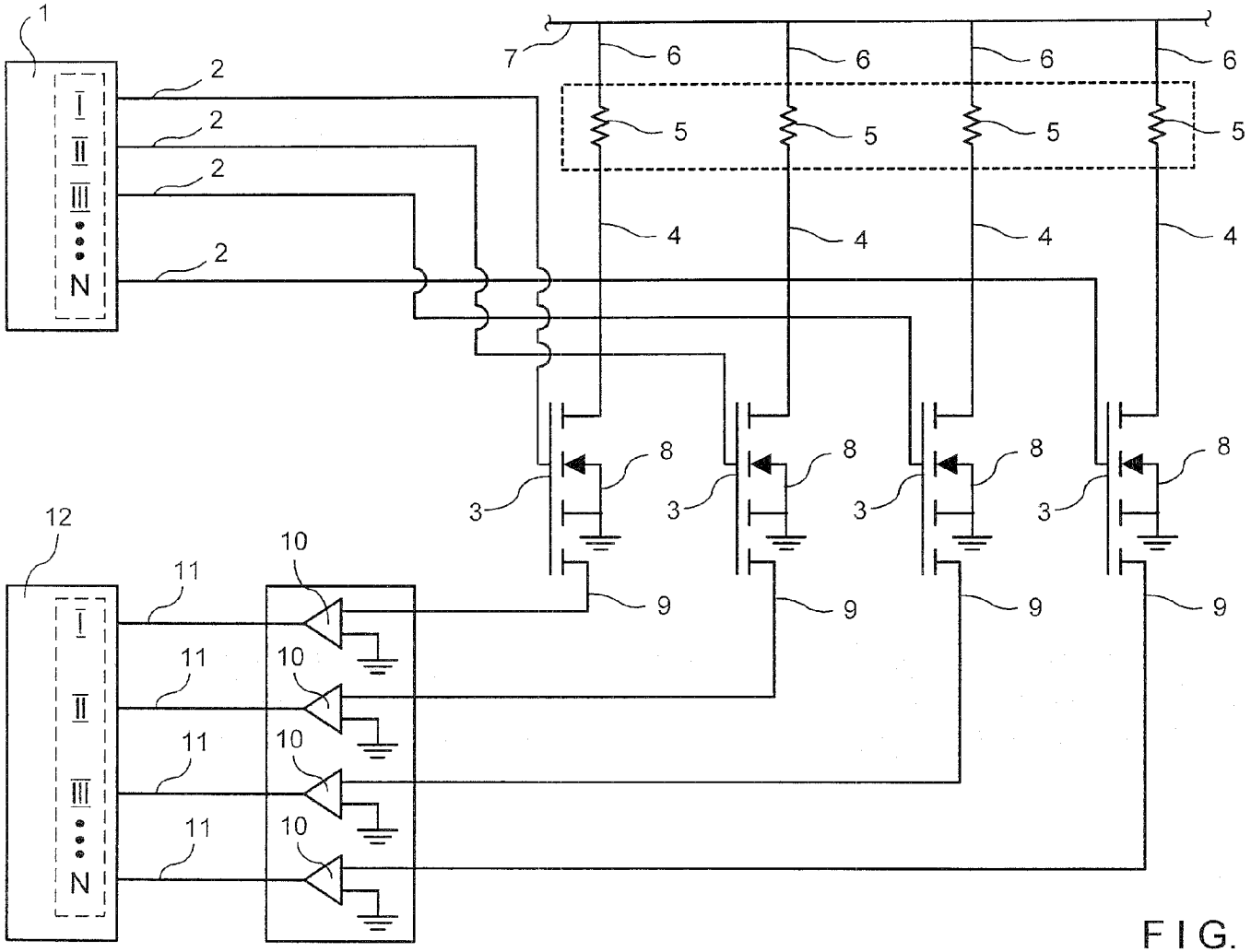

Referring now more particularly to the single FIGURE which illustrates the best mode for carrying out the invention.

As is well known, print control devices use and include a driver 1 which is connected to and as illustrated directly coupled to MOSFET 3 by means of wire 2.

Driver 1 as shown indicates and is related to a plurality of individual circuit elements or components that control or affect the item or voucher to be printed. These current elements or components are designated I, II, III . . . N. Each individual circuit element or component I, II, III . . . N have the same circuitry and for the sake of order, only one will be described because the purpose of this invention is to prevent a defective printing of a voucher which results from a breakdown in one of the circuit elements or components. In effect, each circuit element or component has an affect on the printed voucher which is to be produced by the thermal printer.

Accordingly, circuit element 1-I (and in a similar manner 1-II, 1-III . . . 1-N) driver 1 is coupled by an individual connection means such as a wire 2 directly to MOSFET 3. As noted, each circuit element (I, II, III-N) is connected to MOSFET 3 by its own individual wire 2.

The connection from driver 1 to MOSFET 3 is a direct connection free of any intermediate connections between driver 1 and MOSFET 3. Driver 1 includes or contains all of the circuit elements 1-I, 1-II, 1-III . . . 1-N which are involved in the production and manufacture of correct print.

Feeder 7 is also connected with MOSFET 3, and for this purpose, there are a plurality of lines for connecting the feeder 7 to the MOSFET 3. In this respect, driver 1 also has a plurality of wires 2 which connect the driver to MOSFET 3, one for each of lines connecting feeder 7 to the MOSFET 3.

The lines from feeder 7 joining the MOSFET 3 to each include a thermal resistor 5 associated with one of the operative components of the printer (not shown) and a wire 4 from MOSFET 3 to resistor 5 and a wire 6 from the resistor 5 to the feeder 7. Wires 4 and 6 directly connect thermal resistor 5 to MOSFET 3 and group detector 12, respectively. It should also be noted that thermal resistor 5 is directly coupled to feeder 7 by means of wire 6 and directly coupled to MOSFET 3 by wire 4.

Each MOSFET 3 also includes an internal connection by means of wire 8 to ground in addition to wire 4 to feeder 7 and wire 2 directly coupled to driver 1. Another internal connection to each MOSFET 3 is provided by wire 9 directly coupled to comparator 10 and from comparator 10 connected to group detector 12 by means of wire 11 to provide a direct connection through wire 11 directly to group detector 12.

A single common feeder 7 is provided and each MOSFET 3 and its associated circuitry is connected to the single common feeder 7. Group detector 12 also includes individual detector elements I, II, III . . . N, one for each of the individual circuit elements I, II, III . . . N.

Each MOSFET 3 is connected between Feeder 7 and group detector 12 to provide the required indication when one of the individual components becomes defective by supplying a different voltage and current to MOSFET 3.

DESCRIPTION OF OPERATION

The print control device will provide an indication should a failure or breakdown occur in one or more of the operative components of the thermal printer which components are generally represented by one of the thermal resistors 5 when the current passage through one of the components associated with one of the thermal resistors 5 has an incorrect current and/or voltage applied to it and becomes insufficient or incorrect for MOSFET 3 to operate properly and, therefore, energizes or to activates its associated comparator 10. MOSFET 3 which exploits and provides its own conduction resistance added to the resistance of thermal resistor 5 a tension is exerted which is present in the thermal resistance 5 to render the group detector 12 inoperative to stop operation in response to the thermal resistor 5 and therefore the MOSFET 3 detects a failure or change in electric current supplied to the comparator 10 which because of a decrease or increase in the total effective resistance applied to comparator 10, the group detector 12 becomes operative to stop the thermal printer from operating.

The failure is detected because the effective total electric value which is detected by the comparator is generally different or lower than a predetermined set fixed value which is normally received and registered by the comparator 10 and supplied to the group detector 12, a state register, not shown, or by means of another conventional type or kind of breakdown signaling device also provides an indication of a defect in one of the operative components.

Practically, when MOSFET 3 is actuated, the pilotage of the actuated MOSFET 3 and its associated field or thermal resistor 5 is closed, i.e. when the actuated MOSFET is in its normal operative condition with respect to working with its respective comparator 10 a current is transmitted and on the basis of Ohms; law given to the average between the feeder head potential present to the feeder 7 and the thermal resistor 5 is added to the resistor of the MOSFET 3 in its normal working or operative condition.

Each of the plurality of means for identifying a different fault is determined and controlled by one of the paths which includes wire 9, comparator 10, wire 11 and one of the detectors 12-I, 12-11, 12-III . . . 12-N forming the group detector 12.

This current which is transmitted through each of circuit branches is related to its associated comparator 10 and valued to a respective indication for each individual comparator 10 to provide an indication which component is defective. Therefore, in the case of a failure of one of the plurality of the operative components associated with the thermal resistors 5, the value transmitted to its associated or respective comparator 10 determines the part of the thermal printer that is defective. The group detector 12 identifies the fault and provides an indication to the signaling device which operative component associated with thermal resistor 5 is not capable of operation in a correct manner and having improper or incorrect working values.

It will be evident to those skilled in the art of print control devices for thermal printers that various changes and modifications may be made without departing from the scope of the invention.

This Application claims priority from European Patent Application Serial No. 08425165.1 filed 14 Mar. 2008, the subject matter of which is incorporated by reference as if written herein.

The invention claimed is:

1. A print control device for a thermal printer for detecting a failure in a component of said thermal printer to prevent an incorrect printing of an item to be printed comprising:

a detector (12) for receiving information and for rendering the thermal printer inoperative when an operative component becomes defective;

a feeder (7) associated with a thermal printer head;

at least one thermal resistor (5) indicative of and associated with each said operative component of said thermal printer for checking thereof and a wire (6) for each said thermal resistor for connection of said thermal resistor to said feeder (7) of said thermal printer head;

a print control device for detecting a failure or breakdown of each said thermal resistor (5), said last-mentioned print control device consisting essentially of a single driver (1) including individual components for each said thermal resistor, a MOSFET (3) associated with the driver for each said thermal resistor (5);

a first wire (2) for connecting the gate of said MOSFET (3) to said driver (1) for each said resistor, said MOSFET (3) also being connected by a second wire (4) to said thermal resistor (5) and by a third wire (9) to said detector (12);

each said MOSFET (3) also being connected by a fourth wire (8) to ground and a biunique connection by means of said third wire (9) to a comparator (10) for each said thermal resistor such that said MOSFET is in series with said thermal resistor (5);

each said comparator (10) being coupled by a wire (11) to said group detector (12) such that a failure or a breakdown of any one or more of said operative components directed to said group detector (12) to prevent said thermal printer from continuing printing thereby to prevent an incorrect printing and to provide a correct printing by preventing an error in the printing from taking place due to the breakdown in one said operative components.

2. The print control device according to claim 1, wherein each said MOSFET (3) and said driver (1) are directly coupled with each other by said wire (2).

3. A print control device for a thermal printer and for rendering the thermal printer inoperative when an operative component of said thermal printer becomes defective, said print control device comprising:

a feeder (7) associated with said thermal printer and provided with a printing head for control by said print control device;

a group detector (12) for receiving information about the operation and working of each said operative components of said thermal printer for rendering said thermal printer inoperative when at least one of said operative components becomes defective or does not operate properly, said group detector includes a plurality of circuit operative preventors (12-I, 12-II, 12-III . . . 12-N), one for each of said operative components;

a driver (1) including a plurality circuit elements (1-I, 1-II, '-III . . . 1-N), one for each of said operative components and a MOSFET (3) for each of said circuit elements and said operative components and connected to said driver (1) by a first wire (2);

a thermal resistor (5) associated with and responsive to an improper operation of each of said operative components;

each said MOSFET (3) being connected to said feeder (7) through a respective one of said thermal resistors (5) by means of a second wire (4) for each said resistor (5) and by a third wire from said resistor (5) to said feeder (7);

each said MOSFET (3) also being connected to said group detector (12) through a comparator (10) by a fourth wire (9) connecting said comparator (10) to said MOSFET (3) and a fifth wire (11) connecting said comparator (10) to a respective one of said plurality of circuit operative preventors (12-I, 12-II, 12-III . . . 12-N);

whereby a failure or breakdown of at least one of said operative components causes its associated thermal resistor (5) to become activated such that its associated MOSFET causes its associated comparator (10) to render said detector (12) operative to prevent said printer from operating and thereby to stop further operation of said thermal printer to prevent a printing error from taking place.

4. The print control device according to claim 3, wherein each said plurality of circuit elements is connected to the gate of the respective MOSFET (3) associated with said operative component.

5. The print control device according to claim 3, wherein the emitter of said MOSFET (3) is connected to ground.

6. The print control device according to claim 4, wherein the emitter of said MOSFET (3) is coupled to ground.

7. The print control device according to claim 3, wherein the MOSFET (3) and its associated driver are directly coupled together.

8. The print control device according to claim 3, wherein said MOSFET (3) and said comparator (10) are directly coupled together.

9. A method for controlling an output product of a thermal printer and for rendering the thermal printer inoperative when an operative component of the thermal printer becomes defective, including:

providing a thermal resistor for each of the operative components and coupling the thermal resistor to a feeder (7) associated with said thermal printer and having a printing head;

providing a group detector (12) for receiving information about the operation and working of components of said thermal printer for rendering said thermal printer inoperative when one of said components becomes defective or does not operate properly, the group detector includes a plurality of circuit operative preventors (12-I, 12-II, 12-III . . . 12-N), one for each of said components and associated with a respective one of the thermal resistors;

providing a driver (1) including a plurality of circuit elements (1-I, 1-II, '-III . . . 1-N), one for each of the operative components and a MOSFET (3) for each of the circuit elements and coupling each of the thermal resistors to the driver (1);

coupling each said MOSFET (3) to the feeder (7) through a respective one of the thermal resistors (5) by means of wire 4 for each of the thermal resistors (5) and to the feeder (7), and coupling each said MOSFET (3) to the group detector (12) through a comparator (10) to compare the normal output of the MOSFET to an inaccurate output from the MOSFET caused by one of the incorrectly operating operative components, and coupling the comparator (10) to the MOSFET (3) and to a respective one of the plurality of circuit operative preventors of the group detector for activation thereof in response to an output from the MOSFET produced by the incorrectly operating component;

whereby a failure or breakdown of any of the operative components associated with the thermal resistors (5) stops or prevents further operation of the thermal printer thereby preventing an error from taking place when the thermal printer is printing.

10. The method according to claim 9, wherein each of the plurality of circuit elements is connected to the gate of its associated respective MOSFET (3).

11. The method according to claim 9, including coupling the emitter of each MOSFET to ground.

12. The method according to claim 10, including coupling the emitter of each MOSFET to ground.

13. The method according to claim 9, including coupling each MOSFET (3) directly to the driver.

14. The method according to claim 9, including coupling the MOSFET (3) and the comparator (10) directly together for each component of the thermal printer.

15. The method according to claim 9, including:

coupling the thermal resistor (5) indicative of the operative component of the thermal printer together with the MOSFET (3) for each of the thermal resistors (5) to provide a complete circuit between the group detector (12) and the driver (1).

* * * * *